US005550625A

United States Patent [19]

Takamatsu et al.

[11] Patent Number: 5,550,625

[45] Date of Patent: Aug. 27, 1996

[54] COLOR IMAGE FORMING APPARATUS PROVIDING REGISTRATION CONTROL FOR INDIVIDUAL COLOR IMAGES

[75] Inventors: Masahiro Takamatsu; Masao Ito, both of Kanagawa, Japan

[73] Assignee: Fuji Xerox Co., Ltd., Tokyo, Japan

[21] Appl. No.: 126,553

[22] Filed: Sep. 27, 1993

[30] Foreign Application Priority Data

Sep. 28, 1992 [JP] Japan ..... 4-281085

[51] Int. Cl.[6] ..... G03G 15/01

[52] U.S. Cl. ..... 355/326 R; 347/116; 355/272

[58] Field of Search ..... 355/326 R, 327, 355/208, 218, 246, 204, 272, 275, 317, 115, 116; 346/157, 108

[56] References Cited

U.S. PATENT DOCUMENTS

| | | | |
|---|---|---|---|
| 4,916,547 | 4/1990 | Katsumata et al. | 358/300 |
| 4,937,664 | 6/1990 | Chika et al. | 358/75 |
| 4,972,088 | 11/1990 | Weyer et al. | 250/548 |
| 4,990,969 | 2/1991 | Rapkin | 355/327 |
| 5,146,087 | 9/1992 | VanDusen | 250/271 |
| 5,160,946 | 11/1992 | Hwang | 346/157 |
| 5,208,796 | 5/1993 | Wong et al. | 369/97 |
| 5,241,400 | 8/1993 | Itagaki | 358/401 |
| 5,257,037 | 10/1993 | Haneda et al. | 346/76 L |
| 5,257,047 | 10/1993 | Hareda et al. | 346/160 |
| 5,278,625 | 1/1994 | Charnitski et al. | 355/326 R |
| 5,291,223 | 3/1994 | Ogane et al. | 346/108 |
| 5,291,245 | 3/1994 | Charnitski et al. | 355/205 |
| 5,300,961 | 4/1994 | Corona et al. | 250/494.1 X |

FOREIGN PATENT DOCUMENTS

| | | |
|---|---|---|
| 63-271275 | 11/1988 | Japan . |
| 63-300259 | 12/1988 | Japan . |
| 63-300260 | 12/1988 | Japan . |
| 1-270073 | 10/1989 | Japan . |
| 1-281468 | 11/1989 | Japan . |

*Primary Examiner*—Thu Anh Dang

*Attorney, Agent, or Firm*—Finnegan, Henderson, Farabow, Garrett & Dunner, L.L.P.

[57] ABSTRACT

A color image forming apparatus for forming a color image by transferring images of different colors on a recording medium in a multi-transfer mode. The color image forming apparatus includes a plurality of image forming units for successively forming color images of different colors according to image information, a transfer/transport unit for transporting different color images formed by the image forming units in a state that the color images are successively transferred thereon, a detecting unit for detecting patterns used for detecting an out-of-registration of the color images formed on the transfer/transport unit by the image forming units, and a correcting unit for correcting positions of the color images to be transferred on the transfer/transport unit according to data signal output from the detecting unit. In the apparatus, the transfer/transport unit includes a belt having a light transmission characteristic, the detecting unit includes a light source and a photosensing element which are opposed with respect to the belt. The light source includes a light emitting diode, and the photosensing element includes a photosensing element for detecting the patterns used for detecting the out-of-registration of the color images that are formed on the transfer/transport unit, through a lens-array imaging element.

4 Claims, 8 Drawing Sheets

COLOR IMAGE FORMING APPARATUS PROVIDING REGISTRATION CONTROL FOR INDIVIDUAL COLOR IMAGES

BACKGROUND OF THE INVENTION

1. Field of the Invention

The present invention relates to a color image forming apparatus for forming a color image by transferring images of different colors on a recording medium in a multi-transfer mode. More particularly, the invention relates to a color image forming apparatus which can accurately detect wrong positions of individual images transferred in a multi-transfer mode.

2. Discussion of the Related Art

Of this type of color image forming apparatuses, a color image forming apparatus capable of forming a color image at a high speed has a plurality of image forming units each including a photoreceptor drum, a laser beam scanner for writing image data on the photoreceptor drum by scanning thereon, a developing unit for developing a latent electrostatic image formed on the photoreceptor drum surface, and the like. Color images of different colors formed by those image forming units are sequentially transferred on a recording medium, which is transported by a transport unit as a belt, thereby superimposing the color images into a color image.

This color image forming apparatus can effectively form a color image since the color image is formed by sequentially transferring the color images of different colors formed by the image forming units on a recording medium. However, the apparatus is disadvantageous for the following reason. It is difficult for image transfer to exactly position the color images formed by the image forming units on the recording medium being transported by the transport unit. When the color images are positioned not exactly, the transferred color images are in the wrong position on the recording medium. The resultant color image has unsatisfactory color quality because of its minute out-of-registration of colors.

The wrong position of the transferred color images is caused by rotation speed error of the photoreceptor drums, speed error of the transport unit, error of the image writing timings of the image forming units, and further minute variation among the image forming units or deformation of the units per se, that are produced when ambient conditions of external force applied to the apparatus, temperature, and the like are varied, variation of timings for various controls, and others.

With regard to the cause of the rotation speed error, the out-of-registration of colors can be reduced up to a tolerable level by properly adjusting the rotation speeds of the photoreceptor drums in a factory before delivery of the apparatuses. For the cause of the ambient conditions, also after the apparatuses are sold, the ambient conditions of forces acting on the apparatuses per se, temperature and the like vary day by day when the apparatuses are used. Thus, only the adjustment in factories is insufficient in obtaining a stable and good quality of the reproduced color image.

To solve the above problems, there are proposed techniques as disclosed in Japanese Patent Unexamined Publication Nos. Sho. 63-271275 and Hei. 1-281468. Each proposed color image forming apparatus includes a plurality of image forming units for forming a visual image corresponding to the image information of an image on an original document and a visual image of a position detecting mark as well, a moving member for successively moving a transfer area to which the visual image corresponding to the image information of the original document image and the visual image of the position detecting mark are transferred, and a mark detecting unit, located downstream in the transfer area as viewed in the moving direction of the moving member, for detecting the position detecting mark transferred onto the moving member, wherein the image forming units are controlled according to a detection signal output from the mark detecting unit so as to correct the out-of-registration of the transferred and superimposed images.

However, the conventional techniques have the following problems. As described above, in each proposed color image forming apparatus, a visual image of a position detecting mark is formed on the moving member by each image forming unit. The position detecting mark is detected by the mark detecting unit located downstream as viewed in the moving direction of the moving member. Each image forming unit is controlled according to the signal output from the mark detecting unit so as to correct the out-of-registration of the transferred and superimposed images.

Usually, a transport belt for transfer material is used for the moving member. The mark detecting unit is disposed at a location where the image transfer to the lowest part of the moving transport belt is completed. The mark detecting unit is usually a reflection type sensor which illuminates the surface of the belt and senses light reflected by the belt.

In the case of the transport belts of some specific colors, the difference between the reflectivity of the toner color forming the position detecting mark and that of the belt surface is small. Under this condition, the mark is frequently mistakenly detected.

Japanese Patent Unexamined Publication No. Hei. 1-270073 discloses a technique for solving this problem of mistakenly detecting the mark. In the technique, the mark detecting unit operates in response to light of a specific wavelength for detecting the mark.

The spectral reflectance of four colors, yellow (Y), magenta (M), cyan (C), and black (K), that are used for color image formation, are different from one another. The sensitivity of the sensor used for the mark detecting unit varies depending on the wavelength of sensed light. Accordingly, if the sensor operates in response to light of a specific wavelength, the light sensing conditions are different according to those colors. The output signals of the sensor are not uniform. The result is the complexity of the mark position detecting process. To secure an accurate mark detection of each toner color, the specific wavelength of light must be changed every toner color. This needs a color sensor, a color filter, and the like. To handle light of different wavelengths, a broad range of wavelengths is required for the illuminating unit. The light source that can be used is limited to a specific light source, e.g., a halogen lamp. The construction of the mark detecting unit is complicated. When the halogen lamp is used, electric power is greatly consumed, and a measure for heat is required because it is located near the belt.

As the color image forming apparatus for detecting the position detecting mark by a transmission type illumination, those disclosed in Japanese Patent Unexamined Publication Nos. Sho. 63-300259 and Sho. 63-300260 have been proposed. Each of the disclosed color image forming apparatuses includes an image bearing member for bearing an image, a moving unit moving so as to transfer the image on the image bearing member at a transfer location, a registration mark forming region consisting of a transparent member provided on the moving unit, a detecting unit for detecting a registration mark formed in the registration mark forming region, and a correcting unit for correcting the position of the image on the image bearing member according to the signal output from the detecting unit.

In the proposals of the color image forming apparatuses, any specific construction of the mark detecting unit is not referred to. The registration mark forming region consisting of a transparent member must be additionally provided on the moving unit. Accordingly, the width of the moving unit is increased by the space of the registration mark forming region, so that the apparatus size is increased. The moving unit must be combined with another material forming the transparent member, thereby possibly making it difficult to stably support and transport the moving unit in a state that the moving unit is tensioned.

The present market demand constantly pressures reduction of the apparatus size. In consideration of this, the mark detecting unit must be designed so as not to affect a great influence on the apparatus size. Usually, the mark detect unit is located at the location where the image transfer to the lowest part of the moving transport belt is completed. Accordingly, it is brought into line with the plurality of image forming units. This layout of those components increases the apparatus size. There are many proposals in which the position detecting mark is detected at the roller portion supporting the belt located at the lowest part of the moving belt. The lowest roller portion, located near the heat fixing stage, is affected by heat from the fixing stage, guaranteeing an unsatisfactory accuracy of the mark detecting unit. This problem could be solved if the mark detecting unit is located apart from the fixing stage within an allowable distance. In the case of the mark detecting unit of the reflection type, its width as viewed in the transporting direction is long. Accordingly, the apparatus size is inevitably increased.

SUMMARY OF THE INVENTION

The present invention has been made in view of the above circumstances and has an object to provide a color image forming apparatus which can accurately detect patterns for image position detection irrespective of different toner colors, with small size and small power consumption, and can accurately correct the out-of-registration of the transferred and superimposed color images.

To achieve the above object, the invention provides a color image forming apparatus including a plurality of image forming means for successively forming color images of different colors according to image information, transfer/transport means for transporting different color images formed by the image forming means in a state that the color images are successively transferred thereon, detecting means for detecting patterns used for detecting an out-of-registration of the color images formed on the transfer/transport means by the image forming means, and correcting means for correcting positions of the color images to be transferred on the transfer/transport means according to data signal output from the detecting means, wherein the transfer/transport means includes a belt having a light transmission characteristic, the detecting means includes a light source and a photosensing element which are opposed with respect to the belt, the light source includes a light emitting diode, and the photosensing element includes a photosensing element for detecting the patterns used for detecting the out-of-registration of the color images that are formed on the transfer/transport means, through a lens-array imaging element.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings, FIG. 1 a sectional view showing the overall construction of a digital color copying machine as an embodiment of a color image forming apparatus according to the present invention.

DETAILED DESCRIPTION OF THE PREFERRED EMBODIMENTS

The preferred embodiments of a color image forming apparatus according to the present invention will be described with reference to the accompanying drawings.

Figure 1:
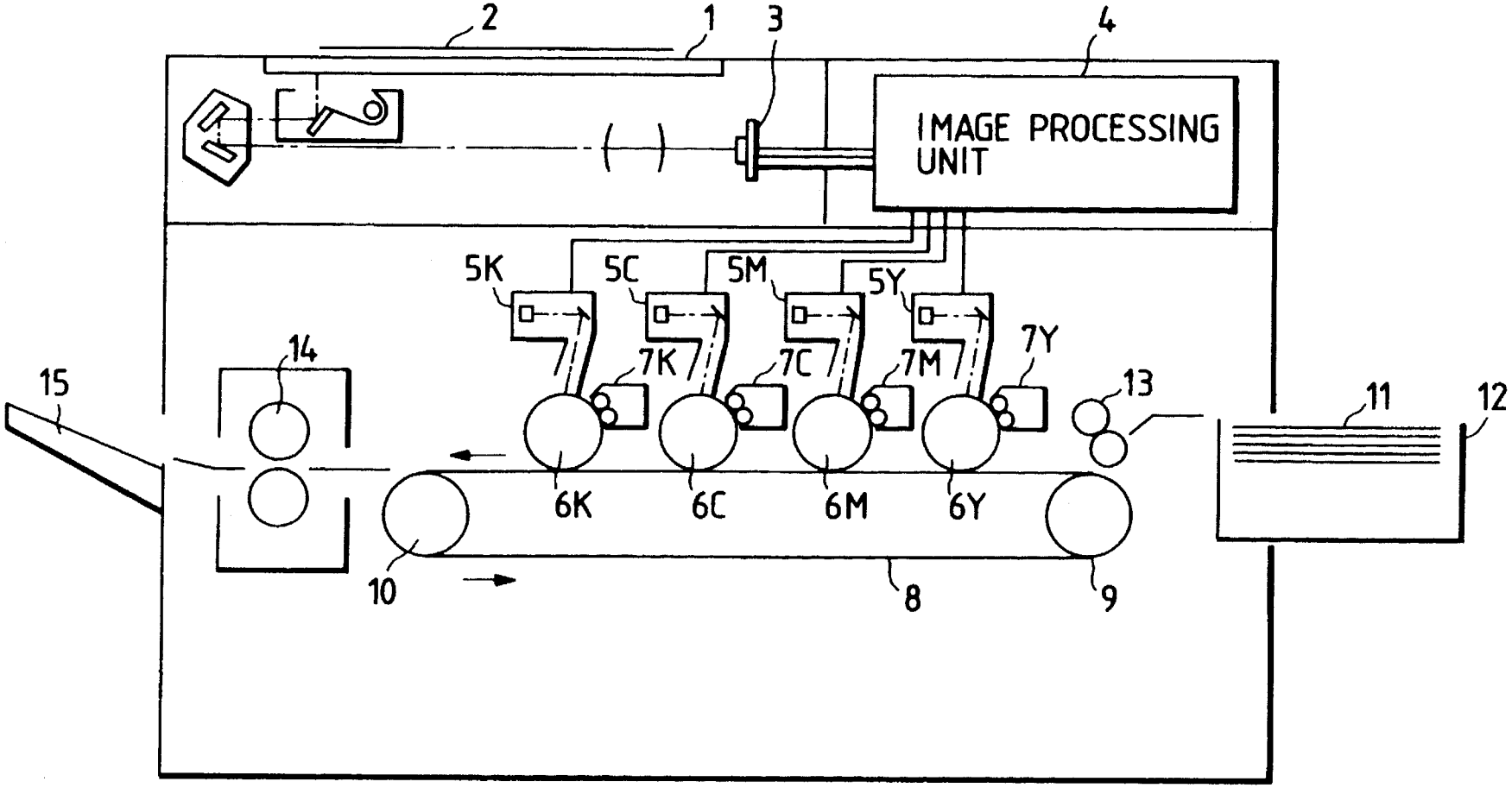

FIG. 1 is a sectional view showing the overall construction of a digital color copying machine as a specific example of a color image forming apparatus according to the present invention. An image forming process will be described with reference to the drawing of FIG. 1.

An image on an original document 2 located on a platen glass 1 is read in the form of analog image signals R, G, and B by the combination of an image scanner having a color CCD sensor 3 and a scanning optical system including a light source, a scan mirror, and the like. The analog image signals R, G, and B from the color CCD sensor 3 are converted into image data signals of Y, M, C, and K by an image processing unit 4. The converted image data signals are temporarily stored in a memory contained in the image processing unit 4.

The image processing unit 4 sequentially outputs the image data signals of those colors to laser beam scanners 5Y, 5M, 5C and 5K in an image forming unit. The beam scanners 5Y, 5M, 5C and 5K form respectively latent electrostatic images on the surfaces of photoreceptor drums 6Y, 6M, 6C and 6K according to the received image data signals. The latent electrostatic images formed on the drum surfaces are developed into toner images of four colors, yellow (Y), magenta (M), cyan (C), and black (K) by developing units 7Y, 7M, 7C, and 7K, respectively.

A sheet of recording paper 11 on which toner images of the four colors are to be transferred from the surfaces of the photoreceptor drums 6Y, 6M, 6C and 6K, is supplied from a paper supply cassette 12. The sheet of recording paper 11 fed from the paper supply cassette 12 is fed onto a transfer/transport belt 8 by a feed roller pair 13 that is driven for rotation at preset timings. The transfer/transport belt 8 as an endless belt is wound around a drive roller 9 and a follower roller 10 while being stretched at a fixed tension. The belt 8 is rotated in the direction of an arrow at a preset speed by the drive roller 9, which is driven for rotation by a motor (not shown) stably operating at a constant speed, exclusively provided for the roller.

The sheet feeding timing and the image writing timing are selected so that the leading edge of the sheet of recording paper 11 transported by the transfer/transport belt 8 and the leading edge of an image formed on the first photoreceptor drum 6Y formed by the image forming unit are coincident with the transfer point at the lowest part of the photoreceptor drum 6Y when seen in the rotation direction of the drum. At this transfer point, the sheet of recording paper 11 receives the visual image from the photoreceptor drum 6Y by a corotron (not shown) and the like, and moves forward to reach a transfer point right under the photoreceptor drum 6M. At this transfer point, the sheet of recording paper 11 receives a visual image from the photoreceptor drum 6M as received from the photoreceptor drum 6Y. In this way, the sheet of recording paper 11 receives visual images from the remaining photoreceptor drums, and then transported by the transfer/transport belt 8, and reaches a location near to the follower roller 10 where it is peeled off the transfer/transport belt 8 by means for separating the sheet of recording paper 11 from the transfer/transport belt 8, such as a corotron, a stripper and the like. Thereafter, the toner image on the sheet of recording paper is fused or fixed onto the sheet by a fusing unit 14, and discharged into a tray 15.

Figure 2:
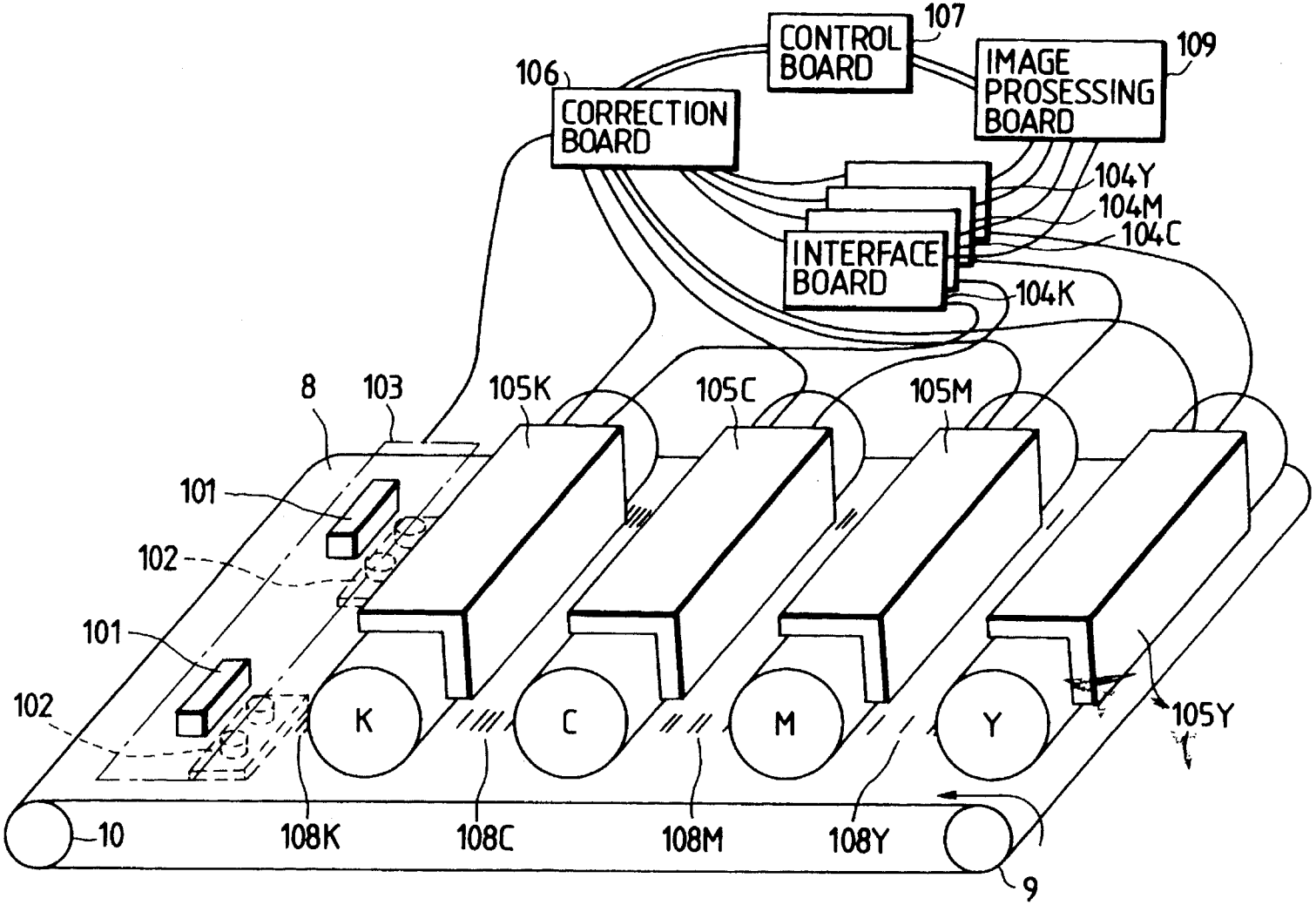
FIG. 2 is a perspective view showing a system for correcting an out-of-registration of colors incorporated into the digital color copying machine.

FIG. 2 is a perspective view showing a system for correcting an out-of-registration of colors incorporated into the digital color copying machine.

In the figure, reference numeral 103 designates a pattern detecting unit for detecting pattern images 108 for image position detection that is formed on the transfer/transport belt 8 by image forming units 105Y, 105M, 105C, and 105K. The pattern detecting unit 103 includes a set of a light source 102 and a photosensing element 101 located on one side of an image area on the transfer/transport belt 8 and another set of a light source 102 and a photosensing element 101 located on the other side thereof. The light sources 102 are LEDs (light emitting diodes) for producing a back light that is required for detecting the pattern images on the transfer/transport belt 8. The photosensing element 101 and the light source 102 of each set are opposed with respect to the transfer/transport belt 8.

Reference numerals 104Y, 104M, 104C, and 104K designate interface boards used for transferring image signals to the laser beam scanners in the image forming units 105Y, 105M, 105C, and 105K. Reference numeral 106 designates a correction board for controlling a system for correcting an out-of-registration of color images. Numeral 109 designates an image processing board containing memories and an image processor. Numeral 107 designates a control board for controlling the system operation.

The digital color copying machine must stably and reliably detect the patterns for color out-of-registration detection in order to minimize a color out-of-registration, and further must be small in size and consume less power. The construction to realize such a digital color copying machine will be described.

To realize a stable and reliable detection of the color out-of-registration detect patterns, the following conditions must hold:

1) A large difference (contrast) is present between the output signal of the photosensing element 101 when it senses a pattern portion and that of the element when it senses a nonpattern portion (background portion).

2) Little difference is present among the output signals of the photosensing elements 101 when they sense different colors.

3) A quantity of light is large enough for the detection.

Figure 3:
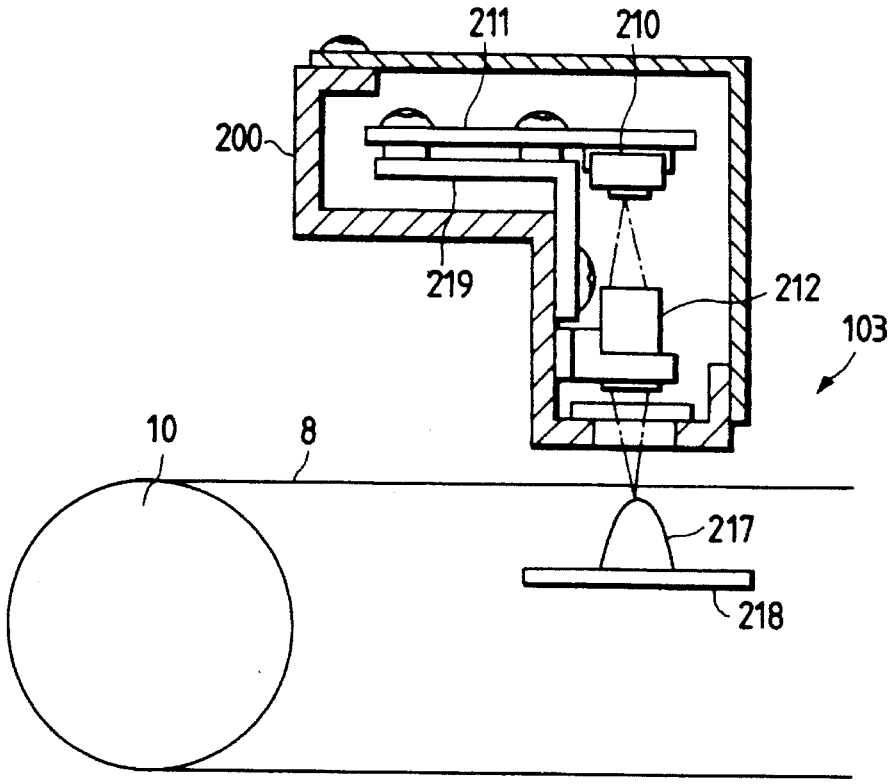
FIG. 3 is a sectional view showing a pattern detecting unit for detecting patterns used for detecting image positions, which is incorporated into the digital color copying machine.

FIG. 3 is a sectional view showing the pattern detecting unit 103 for detecting patterns, used for detecting image positions.

In the figure, reference numeral 200 designates a housing of the pattern detecting unit 103; 210, a linear CCD as the photosensing element 101; and 211, a sensor board having the linear CCD 210 and its peripheral circuit. The sensor board 211 is mounted on the housing 200 by means of an angle member 219 shaped like L. Reference numeral 212 designates a lens-array imaging element, and numeral 218 designates a light source board having a illumination light source 217 as the light source 102 and a peripheral circuit for driving it.

Figure 4:
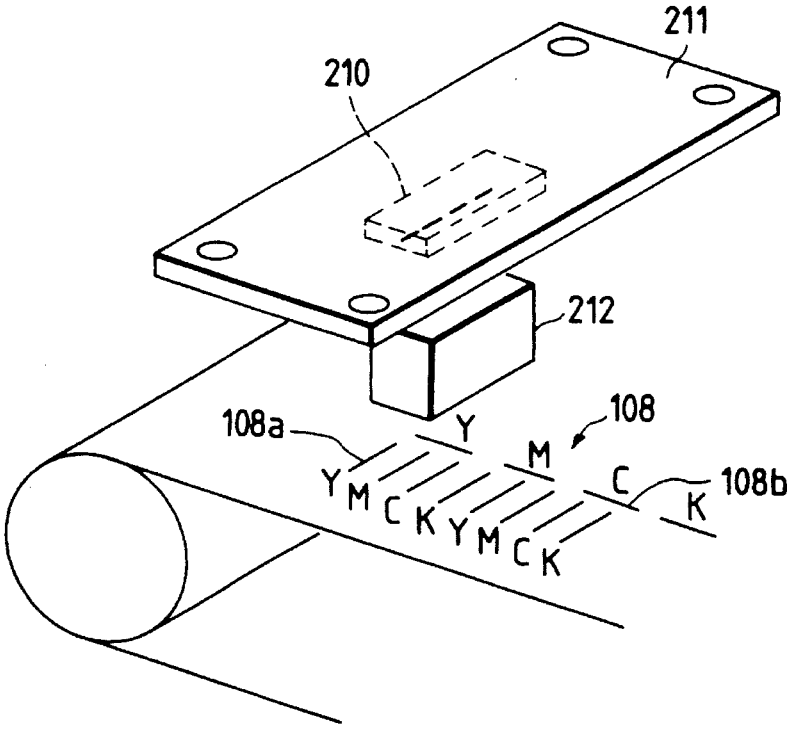
FIG. 4 is a perspective view three-dimensionally showing a positional relationship among a sensor board having a CCD, a lens-array imaging element, pattern images formed on a transfer belt in the digital color copying machine.

FIG. 4 is a perspective view three-dimensionally showing a positional relationship among the sensor board 211 having the linear CCD, the lens-array imaging element 212, pattern images 108 formed on the transfer/transport belt 8 in the digital color copying machine. A set of the sensor board 211 and the lens-array imaging element 212 and another set of them are disposed within the housing 200. The housings 200 are disposed at locations equally distanced from the center of the image area (as viewed in its width) on the transfer/transport belt 8. The linear CCDs 210 mounted on both the sensor boards 211 are each used for sensing pattern images **108*a* for sensing an out-of-registration of the color images in the fast scan direction, and for sensing pattern images 108*b* for sensing an out-of-registration of the color images in the slow scan direction. Since two sensors are thus used, it is possible to adjust out-of-registration of the colors every direction, such as the out-of-registration or offset in the fast and slow scan directions, magnification error, and angular offset in the fast scan direction. One sensor may be used for the adjustment only for the fast scan direction. The housings 200 having two sensors thus arrayed are mounted as shown in FIG. 2**.

As the illumination light source 217, one converging type LED is assigned for a location for detecting an out-of-registration of colors. When an offset of the scan start position of the laser beam scanner, or in the fast scan direction and an offset in the transfer/transport direction, or the slow scan direction, are detected at the same position by one sensor CCD 210, one LED 217 is used. When those out-of-registrations are detected at different positions, two LEDs are used. When the converging type LED 217 is disposed in proximity of the transfer/transport belt 8, the width of illumination is substantially equal to the geometrical size of the LED. Since several LEDs are lit, the power consumed is very small.

Figure 5:
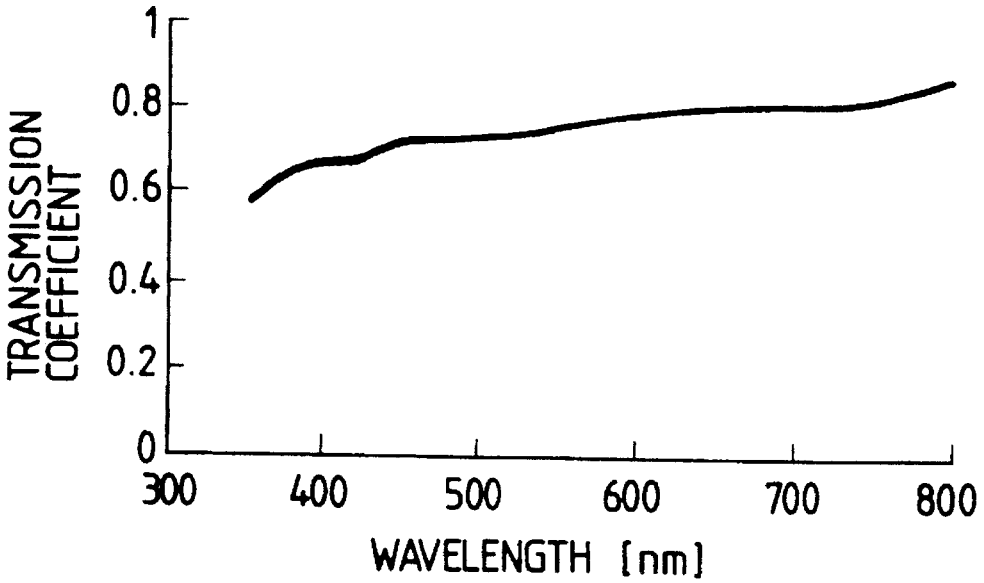
FIG. 5 is a graph showing a transmission characteristic of the transfer/transport belt.
Figure 6:
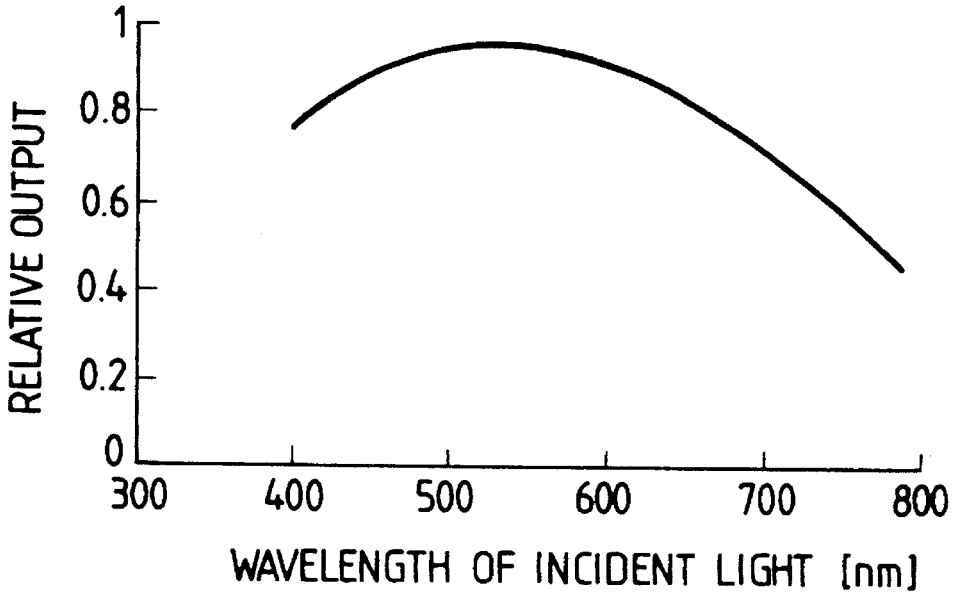
FIG. 6 is a graph showing a sensitivity characteristic of the CCD.
Figure 8:
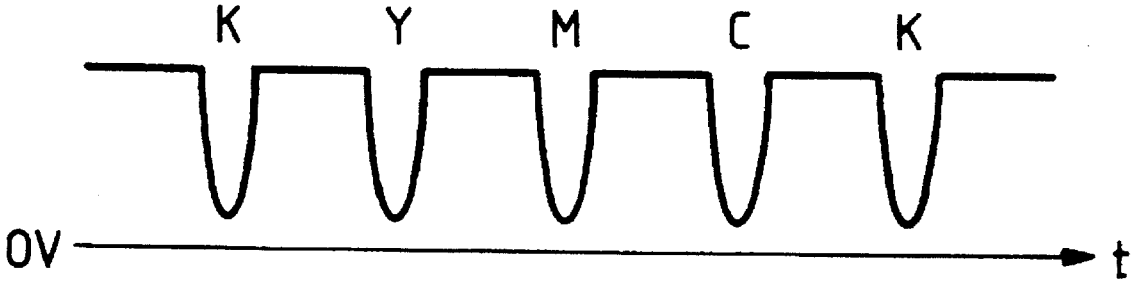
FIG. 8 is a waveform diagram showing an example of the sensor output.

In this embodiment, a transparent belt made of PET (polyethylene terephthalate) is used for the transfer/transport belt 8. A typical transmission characteristic of the transfer/transport belt is shown in FIG. 5. As shown, the transmission coefficient becomes large with the wavelength of light. A typical sensitivity characteristic of the CCD 210 is shown in FIG. 6. As shown, it has a good sensitivity in the visual light region. The wavelengths of light emitted from the LED 217 that exhibit high luminance are within the red color region (600 nm to 700 nm). Those are properly combined to provide a large sensor output. When pattern images 108 on the transfer/transport belt 8 reaches the detecting position, the color toners forming the pattern images 108 are opaque irrespective of colors. The transmission coefficient at the pattern position thereof is approximate to 0, so that the sensor output signal is extremely small. As the sensor output difference becomes larger, the detection is more stable. The sensor output signals of colors Y, M, C, and K have substantially equal amplitudes as shown in FIG. 8. In the present embodiment, the red color region is used; however, if the transmission characteristic of the belt, the spectral reflectance of the photosensing elements, and the intensities of light emitted from the LEDs are combined so as to have the comparable effects, the material of the belt and the wavelengths of the LEDs may be selected properly.

Figure 7:
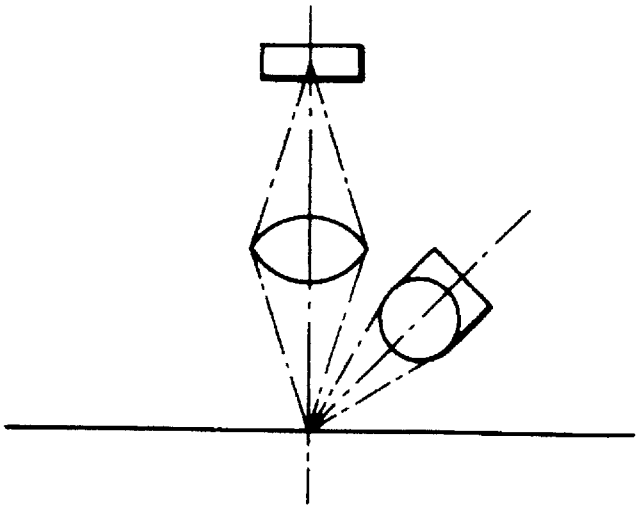
FIG. 7 PRIOR ART
FIG. 7 is a diagram schematically showing the basic construction of a conventional detecting unit.

FIG. 7 is a diagram schematically showing the basic construction of a conventional pattern detecting unit of the reflection type. The optical axis of the detecting element is not coincident with that of the illuminating element, requiring a large space. On the other hand, the detecting element shown in FIG. 3 is of the transmission type. The optical axis of the detecting element is coincident with that of the illuminating element. The optical system section of the detecting element may be reduced in its size as viewed in the transfer/transport direction.

The digital color copying machine thus constructed operates for the detection of the pattern images 108 for the image position detection and the subsequent correction of the color image positions being out of registration.

In the digital color copying machine, the correction of the formed color image positions being out of registration (referred to as "out-of-registration") is executed in a preset correction cycle exclusively provided for the out-of-registration correction. The copying machine is designed with the intention of correcting the image colors being out of registration owing to minute positional deviation of the drums by external force applied, ambient temperature, and the like, and varied timings. Accordingly, removal or setting of the transfer unit at the time of jam trouble, temperature variation within the machine, and the like may be used for the conditions of starting the correction cycle.

In the correction cycle, commands are transferred to the related boards from the control board 107. The interface boards 104Y, 104M, 104C, and 104K serve as a pattern generator for generating patterns for measuring the out-of-registration. The correction board 106 prepares for sampling the pattern images 108 that is transferred from the interface boards 104Y, 104M, 104C, and 104K to the image forming units 105Y, 105M, 105C, and 105K, and output from the image forming units 105Y, 105M, 105C, and 105K.

Figure 9:
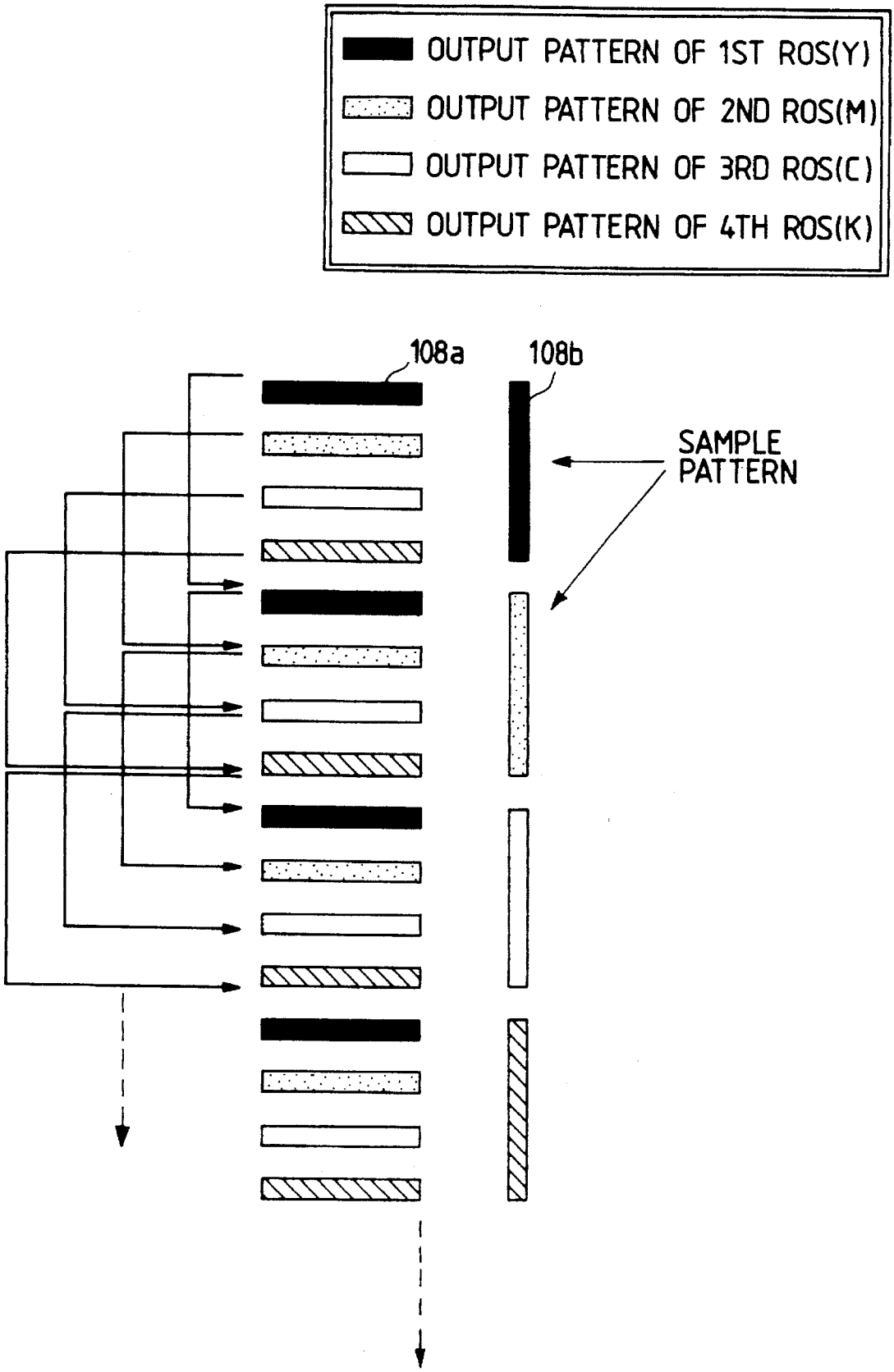
FIG. 9 is a plan view showing patterns for detecting an out-of-registration of the color images.

The pattern images 108 for out-of-registration measurement, used in the embodiment, are as shown in FIG. 9. As shown, linear images of 200 μm wide of Y, M, C, and K colors are arrayed spaced apart given distances in the direction (slow scan direction) of movement of the transfer/transport belt 8 and in the direction (fast scan direction) orthogonal to the former.

When the correction cycle starts, the interface boards 104Y, 104M, 104C, and 104K output patterns for out-of-registration measurement to the image forming units 105Y, 105M, 105C, and 105K. Then, the pattern images 108 formed by the image forming units 105Y, 105M, 105C, and 105K are transferred as a pattern 108Y on the transfer/transport belt 8, as shown in FIG. 2. The pattern that is generated by the interface board 104Y and to be output from the image forming unit 105Y is transmitted to the image forming unit 105Y. Then, after a predetermined time corresponding to the distance between the image forming units 105Y and 105M, a pattern for out-of-registration measurement that is generated by the interface board 104M and to be output from the image forming unit 105M is transmitted to the image forming unit 105M. The pattern formed by the image forming unit 105M is transferred as a pattern 108M on the transfer/transport belt 8.

The pattern 108M is formed at a preset distance from the pattern 108Y already transferred. The subsequent patterns are transferred on the transfer/transport belt 8 in a similar way. When a pattern 108K is transferred, the pattern transfer operation completes.

In the embodiment, the color images are formed in the order of Y, M, C, and K, but may be formed in another order, for example, K, Y, M and C.

The patterns 108 thus transferred are transported right under the photosensing elements 101 of the pattern detecting unit 103, by the transfer/transport belt 8. The correction board 106 for sampling the image data from the photosensing elements 101 is monitoring at least one of the timings of the patterns output from the interface boards 104Y, 104M, 104C, and 104K. It can predict an arrival time of the pattern right under the photosensing elements 101 from the output timing of at least interface board, and calculate the sample start and end timings necessary and satisfactory for sampling the pattern images 108 from a pitch between the sensor and the image forming unit forming the pattern that is output from the interface board.

Figure 10:
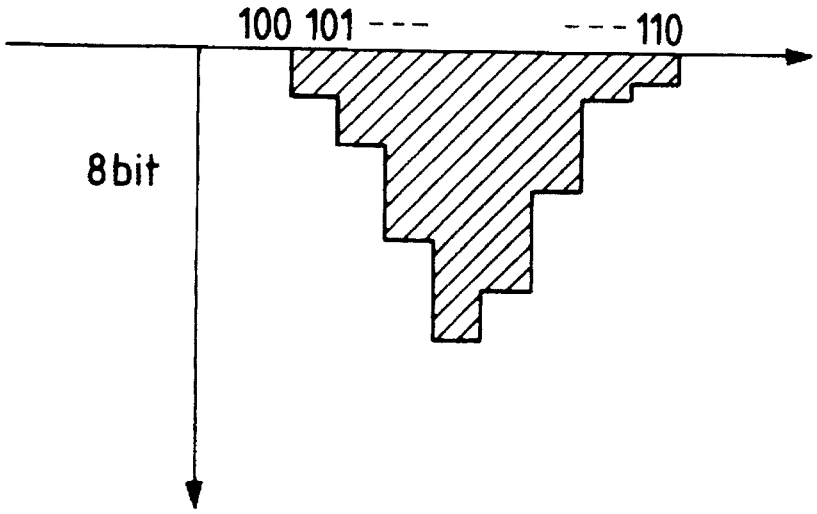
FIG. 10 is a diagram showing a state of the output data signal of the pattern detecting unit stored in a memory.

At the sample start timing, the correction board 106 loads the image signals from the photosensing elements 101 into a high speed memory, as shown in FIG. 10. At the sample end timing, it stops the loading operation. At the same time, it starts to decide an image position from the loaded data using a gravity-center method, for example, and stores it as an image position address in a main memory. Repeating this process, decided image forming addresses are obtained for those image forming units. Averaging the decided image position addresses will improve the accuracy of the image position addresses.

The correction board 106 calculates from the image position addresses decided for the image forming units 105Y, 105M, 105C, and 105K, correction values for correcting the out-of-registration of the color images formed by the image forming units 105Y, 105M, 105C, and 105K for each correction parameter, and for each of image forming units 105Y, 105M, 105C, and 105K. The calculation is performed according to a predetermined algorithm. The out-of-registration correction parameters are offset of the scan start position of the laser beam scanner or in the fast scan direction, offset in the transfer/transport direction or slow scan direction, error of magnification in the fast scan direction, angular offset in the fast scan direction, and the like.

An example of the algorithm for obtaining the out-of-registration or offset of the color images formed by the image forming units 105Y, 105M, 105C, and 105K, will be described hereinafter.

In sampling the patterns, for the sampling start points of the patterns output from the image forming units 105Y, 105M, 105C, and 105K, the next sampling start positions of the same color images formed by the image forming units 105Y, 105M, 105C, and 105K are calculated using the image position data of the patterns of the same color previously output from the corresponding ones. The correction is frequently made so as to minimize differences between the detected points and the calculated points. The image positions of the patterns are measured at small sampling start point width. The offset values of the colors offset from the reference colors are calculated using the calculated color image position addresses, and are used as correction values.

Those correction values are set directly or indirectly in the image forming units 105Y, 105M, 105C, and 105K, the interface boards 104Y, 104M, 104C, and 104K, and the like, from the correction board 106. Then, the correction cycle is completed. Following the correction cycle, the color image forming process by the color image forming apparatus forms a color image of excellent quality in which the color images are well registered.

Figure 11:
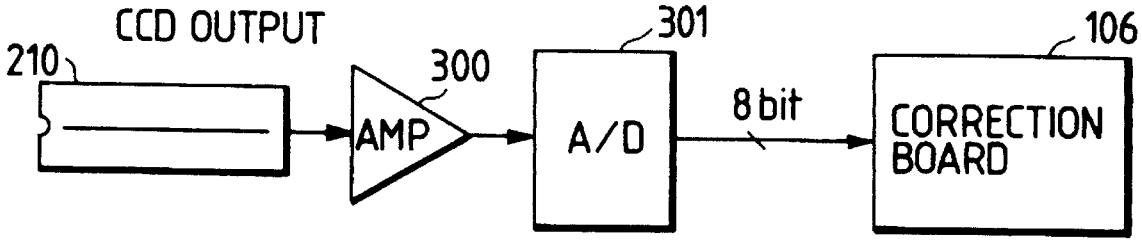
FIG. 11 is a block diagram showing a signal processing circuit according to another embodiment of the present invention.

Another embodiment of the present invention is illustrated in FIG. 11. In the figure, like reference numerals are used for designating like portions in the figure used in the description of the first embodiment described above. The present embodiment is arranged so as to stably detect the patterns for out-of-registration detection for a long time, thereby continuously suppressing the out-of-registration of colors to a minimum for a long time.

FIG. 11 is a block diagram showing a signal processing circuit according to another embodiment of the present invention.

In the figure, reference numeral 210 designates a linear CCD. The output signal of the linear CCD 210 is amplified to a proper magnitude, and is converted into digital data by an A/D converter 301 of 8 bits, for example. Then, the digital data signal is transferred to the correction board 106. The output (background output) of the linear CCD 210 is not uniform because of variations of the transmission coefficient of the optical system, that (reflectivity) of the transfer/transport belt 8, and the light source. This results in deformation of the pattern profiles. Use of the output data from the linear CCD 210 of necessity as intact results in an error in deciding the pattern positions.

Figure 12:
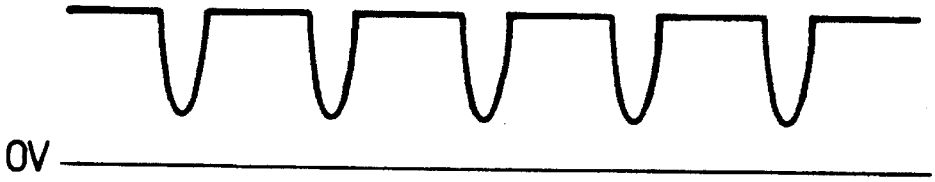
FIG. 12 is a waveform diagram showing a profile of the pattern after the shading correction.

The correction board 106 employs a shading correction as means for removal those various kind of variations. The shading correction is based on the normalization of the background output to 1. The background data is processed to obtain the correction coefficient to the maximum value of each pixel. In sampling the patterns, the pattern data is multiplied by the correction coefficients, thereby obtaining correction profiles, not deformed. The thus corrected data is used for the pattern position calculation. A profile of the pattern after the shading correction is illustrated in FIG. 12.

The quantity of light sensed by the linear CCD 210 gradually decreases with time because of deterioration of the transmission coefficient of the optical system by dust attached thereto, friction with the drive members, deterioration of the transmission coefficient (reflectivity) of the transfer/transport belt 8 by dust attached thereto. The result is reduction of signal amplitudes of the patterns, insufficient resolution, and lowering of the accuracy of the pattern position calculation. To avoid the problems, the quantity of light emitted from the illumination light source 217 is amplified to increase the signal amplitudes. Necessary signal amplitudes can be obtained free from the noise influence from the amplifier 300 while keeping a good S/N.

Next, the light quantity control will be described. The signal amplitude for the pattern position calculation, that is, the background output, depends on the algorithm used for the pattern position calculation. The quantity of illumination light is controlled so that the background output falls within a proper range of levels. The light quantity can be controlled to surely be within the proper level range by setting the rate of change of the light quantity at values within a fixed range of values. The change rate D of the light quantity is expressed by $$P_{max}/P_{min} \geqq D > 1$$

where $P_{max}$ and $P_{min}$ stand for the maximum and minimum values of the background output respectively.

In a case where the necessary quantity of background light is ½ full scale of the output of the A/D converter 301, the light quantity is stepwise controlled so as to be within the range between the full scale and ½ full scale when the quantity of the background light decreases below the ½ full scale. The change rate D of the light quantity is: $2 \geqq D > 1$. The number of control steps is determined to at least two steps according to the estimated decrease of the quantity of light and a rate of change of light quantity per step. As a matter of course, reduction of the rate of change of light quantity enables the light quantity to be controlled within a limited range. Because of the zone control based on the quantity of background light, control means for controlling the light quantity may take a simple construction. The deterioration of the transmission coefficient (reflectivity) of the optical system and the transfer/transport belt 8 gradually progresses and hardly varies during the short period for registration correction. Execution of the light quantity control only at the start of the registration correction lightens the load to the correction cycle.

Figure 13:
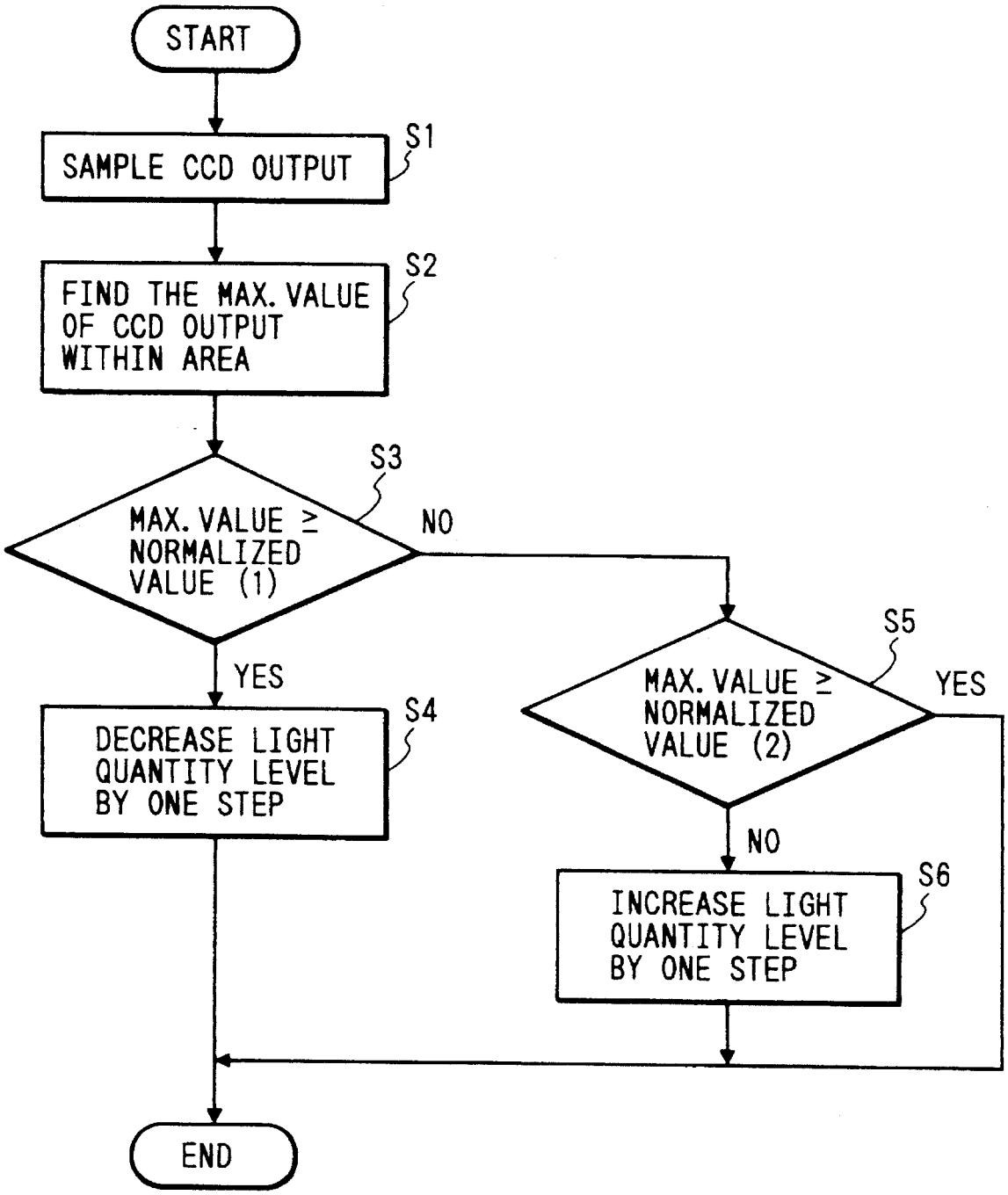
FIG. 13 is a flowchart showing a control flow for controlling the quantity of light.

FIG. 13 is a flowchart showing a control flow for controlling the quantity of light. When the light quantity is outside a desired range, one step variation of the light quantity level can adjust the quantity of background light to be surely within the desired range since the change rate of the light quantity is fixed. In this case, no check of the adjusted light quantity level is required.

In FIG. 13, first, the CCD output signal is sampled (step S1). Next, the maximum value of the CCD output signal within the area is found (step S2). Then, it is discriminated whether or not the maximum value is equal to or greater than the normalized value (1) (step S3). If the result of the discrimination is YES in step S3, the light quantity level is decreased by one step (step S4). On the other hand, if the result of the discrimination is NO in step S3, it is discriminated whether or not the maximum value is equal to or greater than the normalized value (2) (step S5). If the result of the discrimination is NO in step S5, the light quantity level is increased by one step (step S6).

In this embodiment, the color out-of-registration can be suppressed for a long time through the light quantity control. Accordingly, the patterns for out-of-registration detection can be stably detected for a long time.

The remaining construction of the present embodiment is substantially equal to that of the first embodiment. No further description of it will be given here.

As seen from the foregoing description, the present invention has successfully provided a color image forming apparatus which can accurately detect patterns for color image positions irrespective of toner colors, with small size and small power consumption, and can correct the out-of-registration of colors with a high precision.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A color image forming apparatus comprising:

a plurality of image forming means for successively forming color images of different colors according to image information;

transfer/transport means for transporting different color images formed by said image forming means in a state that the color images a re successively transferred thereon;

detecting means for detecting patterns used for detecting an out-of-registration of the color images formed on said transfer/transport means by said image forming means; and correcting means for correcting positions of the color images to be transferred on said transfer/transport means according to data signal output from said detecting means, wherein said transfer/transport means includes a belt having a light transmission characteristic, said detecting means includes a light source and a photosensing element which are opposed with respect to the belt, said light source includes a light emitting diode and emits a quantity of light which is stepwise controllable, and said photosensing element detects the patterns through a lens-array imaging element.

2. The color image forming apparatus according to claim 1, wherein the quantity of light emitted from said light source of said detecting means is controlled only in an initial stage of a correction cycle performed by said correcting means.

3. The color image forming apparatus according to claim 1, wherein the quantity of light emitted from said light source of said detecting means is controllable in at least two steps.

4. The color image forming apparatus according to claim 1, wherein the quantity of light emitted from the light source of said detecting means is controlled at a fixed rate of change of the light quantity.

* * * * *